US009797662B2

(12) United States Patent
Sægrov et al.

(10) Patent No.: US 9,797,662 B2
(45) Date of Patent: Oct. 24, 2017

(54) HEAT EXCHANGER

(75) Inventors: Stein Oddvar Sægrov, Stavanger (NO); Otto Godeset, Stavanger (NO); Rune Myklebust, Ellingsøy (NO)

(73) Assignees: Pleat AS, Stavanger (NO); Sperre Coolers AS, Ellingsoy (NO)

( * ) Notice: Subject to any disclaimer, the term of this patent is extended or adjusted under 35 U.S.C. 154(b) by 584 days.

(21) Appl. No.: 13/821,478

(22) PCT Filed: Sep. 7, 2011

(86) PCT No.: PCT/NO2011/000238

§ 371 (c)(1),
(2), (4) Date: Apr. 30, 2013

(87) PCT Pub. No.: WO2012/033411

PCT Pub. Date: Mar. 15, 2012

(65) Prior Publication Data

US 2013/0213625 A1 Aug. 22, 2013

(30) Foreign Application Priority Data

Sep. 7, 2010 (NO) ..... 20101249

(51) Int. Cl.

| | |
|---|---|
| ***F28F 1/02*** | (2006.01) |
| ***F28D 9/00*** | (2006.01) |
| ***F28F 3/08*** | (2006.01) |
| ***F28F 9/00*** | (2006.01) |
| ***F28F 9/007*** | (2006.01) |

(Continued)

(52) U.S. Cl.

CPC ..... *F28F 1/022* (2013.01); *F28D 9/0025* (2013.01); *F28F 1/045* (2013.01); *F28F 3/083* (2013.01); *F28F 9/001* (2013.01); *F28F 9/0075* (2013.01); *F28F 9/02* (2013.01); *F28F 9/266* (2013.01); *F28F 21/086* (2013.01)

(58) Field of Classification Search

CPC ..... F28D 9/0025; F28D 9/04; F28F 9/0226; F28F 1/022; F28F 1/045; F28F 3/083; F28F 9/001; F28F 9/0075; F28F 9/02; F28F 9/266; F28F 21/086

USPC ..... 165/143, 175, 144, 164–166, DIG. 399

See application file for complete search history.

(56) References Cited

U.S. PATENT DOCUMENTS 2,019,351 A * 10/1935 Lathrop ..... 165/165
3,334,399 A * 8/1967 Teeguarden ..... B21D 53/04 165/166

(Continued)

FOREIGN PATENT DOCUMENTS

CN 1462356 A 12/2003
CN 2786530 Y 6/2006

(Continued)

OTHER PUBLICATIONS

Office Action issued in counterpart Chinese Patent Application No. 2011800431806 dated Sep. 12, 2014 (12 pages).

(Continued)

*Primary Examiner* — Jianying Atkisson
*Assistant Examiner* — Raheena R Malik
(74) *Attorney, Agent, or Firm* — Osha Liang LLP

(57) ABSTRACT

A modular system for heat exchange between fluids includes a plurality of open elements that, by means of two end plates, are connected together. An open element is constituted of a folded and sealed sheet material that is arranged in a frame.

10 Claims, 7 Drawing Sheets

(51) Int. Cl.

| | |
|---|---|
| ***F28F 9/26*** | (2006.01) |
| ***F28F 21/08*** | (2006.01) |
| ***F28F 1/04*** | (2006.01) |
| ***F28F 9/02*** | (2006.01) |

(56) References Cited

U.S. PATENT DOCUMENTS

| | | | | |
|---|---|---|---|---|
| 5,282,507 | A | 2/1994 | Tongu et al. | |
| 5,303,770 | A | 4/1994 | Dierbeck | |
| 5,950,715 | A * | 9/1999 | Jonsson et al. | 165/103 |
| 6,170,567 | B1 * | 1/2001 | Nakada et al. | 165/153 |
| 7,661,415 | B2 * | 2/2010 | Nakamura | 123/568.12 |
| 8,047,272 | B2 * | 11/2011 | Whittenberger et al. | 165/164 |
| 2002/0166657 | A1 * | 11/2002 | Uchison | 165/165 |
| 2004/0094398 | A1 | 5/2004 | Karoliussen | |
| 2004/0109798 | A1 | 6/2004 | Chopard et al. | |
| 2004/0206486 | A1 | 10/2004 | Whittenberger | |
| 2006/0219394 | A1 * | 10/2006 | Martin et al. | 165/157 |
| 2006/0289147 | A1 * | 12/2006 | Zuo et al. | 165/104.26 |
| 2009/0229804 | A1 | 9/2009 | Zebuhr | |
| 2010/0032149 | A1 * | 2/2010 | Roll et al. | 165/175 |
| 2010/0263823 | A1 * | 10/2010 | Mitsuhashi et al. | 165/11.1 |

FOREIGN PATENT DOCUMENTS

| | | | |
|---|---|---|---|
| EP | 0 909 928 | A1 | 4/1999 |
| GB | 512689 | A | 9/1939 |
| GB | 846994 | A | 9/1960 |
| JP | S62-142666 | U | 9/1987 |
| JP | H09243279 | A | 9/1997 |
| JP | H1114296 | A | 1/1999 |
| JP | 11 248388 | A | 9/1999 |
| JP | 2004-509317 | A | 3/2004 |
| NO | 316475 | B1 | 1/2004 |
| WO | 95/30867 | A1 | 11/1995 |
| WO | 02/25198 | A1 | 3/2002 |

OTHER PUBLICATIONS

International Search Report issued in PCT/NO2011/000238 mailed on Jan. 16, 2012 (3 pages).
Norwegian Search Report issued in Patent application No. 20101249 dated Apr. 7, 2011 (1 page).
Patent Abstracts of Japan for Publication No. 11248388; Publication date Sep. 14, 1999 (1 page).
International Preliminary Report on Patentability from PCT/NO2011/000238 issued on Sep. 10, 2012 (5 pages).
Office Action issued in counterpart Japanese Patent Application No. 2013-527031 dated May 26, 2015 (3 pages).

* cited by examiner

HEAT EXCHANGER

CROSS-REFERENCE TO RELATED APPLICATIONS

This application is a national stage application of PCT/NO2011/000238, filed on Sep. 7, 2011, entitled "HEAT EXCHANGER," which claims priority to Norwegian Patent Application No. 20101249, filed on Sep. 7, 2010. Each of these priority applications are incorporated herein by reference in their entireties.

FIELD OF THE PRESENT DISCLOSURE

The present disclosure relates to a modular system for heat exchange between fluids and a plurality of open elements for heat exchange between fluids which are used in the modular system.

BACKGROUND OF THE PRESENT DISCLOSURE

Today heat exchangers are used as standard equipment for efficient heating or cooling, heat recovery, condensation and evaporation in many fields. Heat exchangers may be of different types and designs, which will depend on what type of medium is to be heated or cooled.

The efficiency of the heat exchanger, i.e., its ability to transfer heat between the two media that are to be "heat exchanged", will be highly dependent on how clean the surface of the barrier separating the two media is. In many heat exchanger applications, the media employed, for example, seawater, will cause a soiling of the barrier surface owing to biological fouling, deposits, physical particles or the like, this soiling of the barrier surface substantially reducing the efficiency of the heat exchanger over time. This will mean that after being in use for some time, the heat exchanger will, when the heat transfer capacity approaches a specific minimum level, have to be dismantled for cleaning.

In the marine business or industry, heat exchangers are used for cooling, inter alia, the propulsion machinery of a vessel etc., where seawater is used as "cooling medium". Here, the cleaning of heat exchangers will be both critical and absolutely essential in order to maintain the vessel's required propulsive power.

Today the most common heat exchangers in the marine industry are plate heat exchangers. Heat exchangers of this type are efficient and reliable, but will be difficult and complicated to clean. Such a plate heat exchanger comprises a plate package, which plate package typically comprises a large number of individual plates and a corresponding number of gasket elements, for example, 50-150 plates and a corresponding number of gasket elements, where the individual plates in the plate heat exchanger are assembled to form the plate package. When a heat exchanger of this kind is to be cleaned, it is normally necessary to dismantle the whole plate package, whereby all the plates in the plate package must then be cleaned one at a time, and the same number of gasket elements must either be cleaned or replaced. Dismantling, cleaning and assembly of the said size of heat exchanger is considered to be a full day's job for two people, and represents a substantial cost because of time consumed and use of parts (replacement of gasket elements etc.). The complexity of the cleaning process will mean that there is greater dependence on both available competence and an adequate window of time in order to be able to carry out the cleaning. A lack of available competence and/or window of time will be usual and, as a result, such jobs are increasingly being put in the hands of external companies, which makes this process even more costly, or which also means that the vessel has an enforced period out of service with consequential loss of income.

The modular system for heat exchange between fluids and the open element for heat exchange between fluids in the modular system according to the present disclosure cover the same range of applications as the plate heat exchangers described above, but are provided with a particular view to simplifying the maintenance of the heat exchanger. Requirements as to special competence and/or a larger window of time are virtually eliminated. According to the present disclosure, the modular system will comprise a plurality of open elements, for example, 2-7 open elements, and a corresponding number of individual gaskets. Dismantling, cleaning and assembly are reckoned to be a job of about one hour for one man. Moreover, time consumed and replacement of gasket parts are so reduced as to become insignificant. Furthermore, the actual cleaning process will be so simple that all vessels will have available competence for carrying out this process, and can therefore maintain full control of the cooling capacity of the heat exchanger and thus also critical propulsive power.

WO 95/30867 A1 and NO 316475 B1 describe heat exchanger elements and the manufacture thereof, where it is known that the heat exchanger elements consist of a plate that is folded to form a plurality of slits, where the plate delimits the fluid to be heat exchanged, each fluid flowing in slits on either side of the plate.

EP 909 928 A1 relates to a heat exchanger unit that is used in connection with heat recovery in a building or house, where a plurality of folded plates are provided in a housing, so as to form the heat exchanger unit.

GB 512 689, US 2004/0206486 A1 and US 2009/0229804 A1 teach additional embodiments of heat exchangers and heat exchanger elements.

A common feature of the aforementioned documents is that they do not teach a modular system for heat exchange between fluids, where dismantling/assembly, cleaning and/or maintenance of the modular system has been simplified.

SUMMARY OF THE PRESENT DISCLOSURE

An object of the present disclosure will therefore be to seek to solve one or more of the problems or drawbacks mentioned above.

Another object of the present disclosure will be to provide a modular system and an open element for heat exchange between fluids that are maintenance-friendly.

These objects are achieved by means of a modular system for heat exchange between fluids and a plurality of open elements in the modular system as disclosed in the following independent claims, with additional features of the present disclosure set forth in the dependent claims and the description below.

The present disclosure relates to a modular system for heat exchange between fluids, the system comprising two end plates configured with an inlet and outlet for each of the fluids that are to be heat exchanged, between which two end plates a plurality of open elements are arranged, where two open elements adjacent to one another are so arranged that the sides of the adjacent open elements facing each other carry the same fluid.

The present disclosure also relates to an open element for heat exchange between fluids, the open element comprising a folded sheet material forming a plurality of slits, where the folded sheet material may be stiffened. The ends of the folded sheet material are further sealed by means of an end seal, where the folded sheet material is further arranged in an open frame consisting of a bottom and top frame, each of the ends of the open frame being configured with two through holes which form inlets and outlets for each of the fluids.

An open element according to the present disclosure should be understood to mean an element which exposes essentially the whole surface of the folded sheet material when the folded sheet material is arranged in the open frame. The surface of the open element's folded sheet material is then fully accessible for a simple cleaning process from both sides of the open element, without the folded sheet material having to be dismantled from the open frame.

The number of open elements arranged between the two end plates may vary. For example, in one embodiment of the present disclosure four open elements may be arranged between the end plates, but it will be understood that both greater and smaller numbers of open elements can be used according to the present disclosure.

For assembly of the end plates and the open elements arranged between the end plates, at least one elongate element is used. The end plates will then be configured with at least one through hole, slot, cut-out or the like, where the at least one through hole, slot, cut-out or the like in each end plate are coincident to allow the elongate element to be passed through them so as to assemble the end plates and the intermediate open elements.

The at least one elongate element may be welded to one of the end plates and connected to the other end plate by means of a threaded connection, nut, rapid coupling etc., but it should be understood that the at least one elongate element may also be connected to the end plates in other ways, for example, by a threaded connection, nuts, rapid couplers etc.

When assembling the modular system for heat exchange between fluids according to the present disclosure, a desired number of open elements will be arranged one after the other between the two end plates. The end plates will then be brought towards each other, whereafter one or more elongate elements are used to assemble the end plates and the intermediate open elements.

The elongate elements may, for example, be constituted of a bolt, bar or the like.

In one or more embodiments, the modular system for heat exchange between fluids also comprises at least an inlet filter, which filter is suitably connected to the inlet for one of the fluids. The inlet filter will then reduce the danger of blockages in the modular system. If one of the fluids that are run through the system is, for example, seawater, the inlet filter will prevent contaminants (sand, loose shells etc.) from penetrating into the open elements.

When the end plates and the open elements are assembled to form the modular system for heat exchange between fluids according to the present disclosure, the open elements are arranged such that two adjacent open elements will carry the same fluid on sides facing each other.

The open element that is used in the modular system for heat exchange between fluids according to the present disclosure comprises a sheet material that is folded to form a plurality of slits, which slits constitute the fluid flow paths through the open element. When the sheet material is folded, it will however be "soft", and it therefore may be stiffened.

This stiffening of the sheet material may be obtained, for example, in that the sheet material over at least a part of its length and width is configured with a plurality of stamped portions, which stamped portions are separated from each other by a non-stamped portion. The stamped portions will then form the walls of the slits in the folded sheet material, whilst the non-stamped portions form the fold in the sheet material, the sheet material then being folded about each of the non-stamped portions. The ends of the folded sheet material are further sealed, the sealed and folded sheet material being arranged in a frame.

That the sheet material is stamped should be understood as meaning that the surface of the sheet material is exposed to an external force which will change the shape (projection/depression) of the sheet material. The stamping may be in the form of continuous or discontinuous grooves or channels, dots or also a combination thereof.

It should however be understood that the stiffening of the folded sheet material can also be obtained in other ways, for example, by the provision of spacers between the slits of the folded sheet material.

The aforementioned stiffening means will result in the folded sheet material obtaining a desired stiffness over the whole or parts of the surface of the folded sheet material.

Although the slits in the folded sheet material may be configured as planar faces, it should be understood that they can also be configured as part circles, arcs or the like. An embodiment of the present disclosure may include a structure consisting of forming one or more open areas that permit an efficient high-pressure washing in the slits.

The sheet material in the open element may be constituted of titanium or other suitable materials, in which the sheet material may have a thickness of 0.4 mm-0.6 mm. The distance between each slit in the folded sheet material may furthermore be 2.5 mm-3.5 mm.

The folded sheet material is further arranged in a frame, which frame is constituted of a top and a bottom. The top and the bottom of the frame will, by means of suitable fastening devices, for example, bolts or the like, be connected to each other so as to provide an open element. The top and the bottom of the open element will further comprise channels for inlet, outlet and fluid distribution.

A plurality of gaskets etc. may further be arranged between the top/bottom of the frame and the folded sheet material and/or between the top and bottom of the frame.

The frame may further be configured with a plurality of through holes, such that if the end seal or the gaskets begin to leak, the through holes in the frame will act as outlets for one or both fluids flowing through the open element, in such a way that they are not mixed.

In order to further stiffen the folded sheet material, a number of transverse elements can be placed across the width of the top and/or bottom frame.

To obtain a proper flow of the fluid across the open element, a plate may further be suitably connected to the transverse elements, such that the fluid is "forced" to flow through the slits in the open element.

Other advantages and characteristic features of the present disclosure will be seen clearly from the following detailed description, the appended figures and the following claims.

BRIEF DESCRIPTION OF THE DRAWINGS

The present disclosure will now be described in more detail with reference to the following figures, wherein.

DETAILED DESCRIPTION OF THE PRESENT DISCLOSURE

Figure 1A:
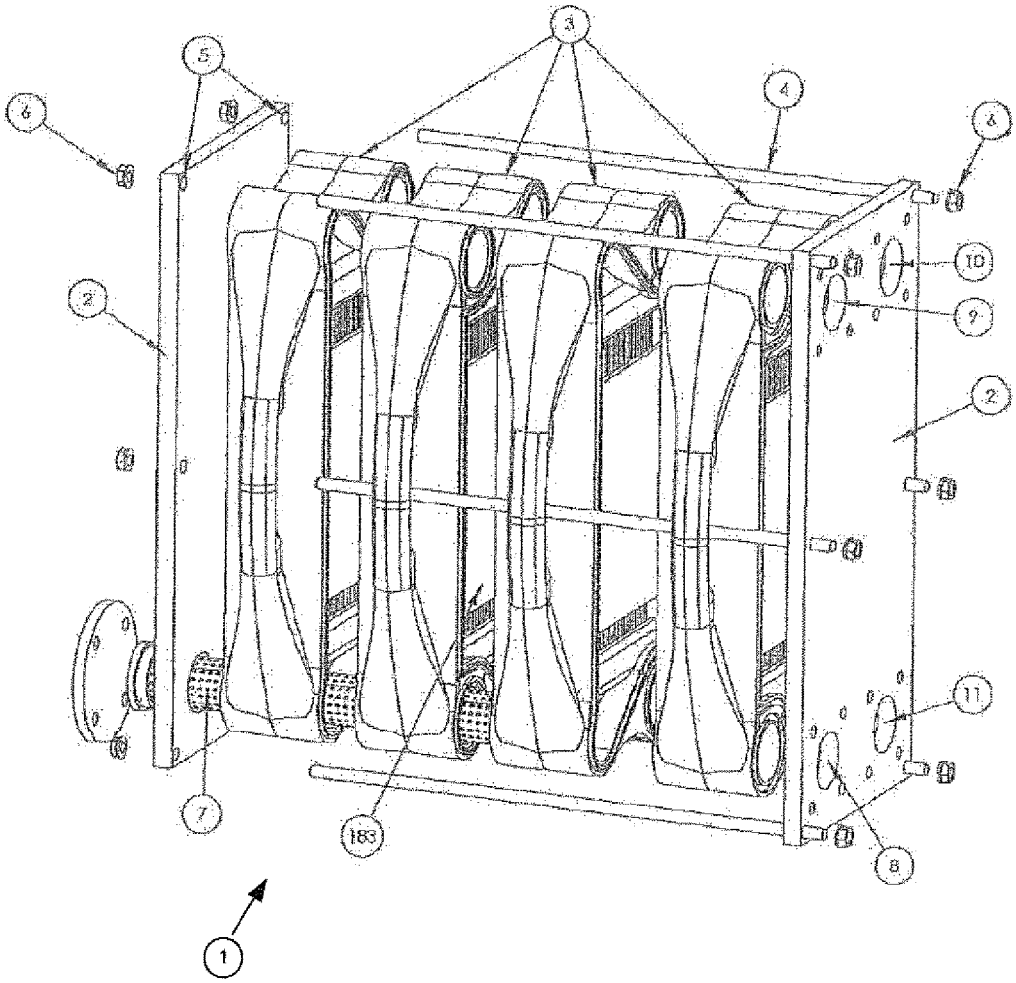
FIGS. 1A-B show a modular system for heat exchange between fluids according to the present disclosure, which is in the process of being assembled and is fully assembled.
Figure 1B:
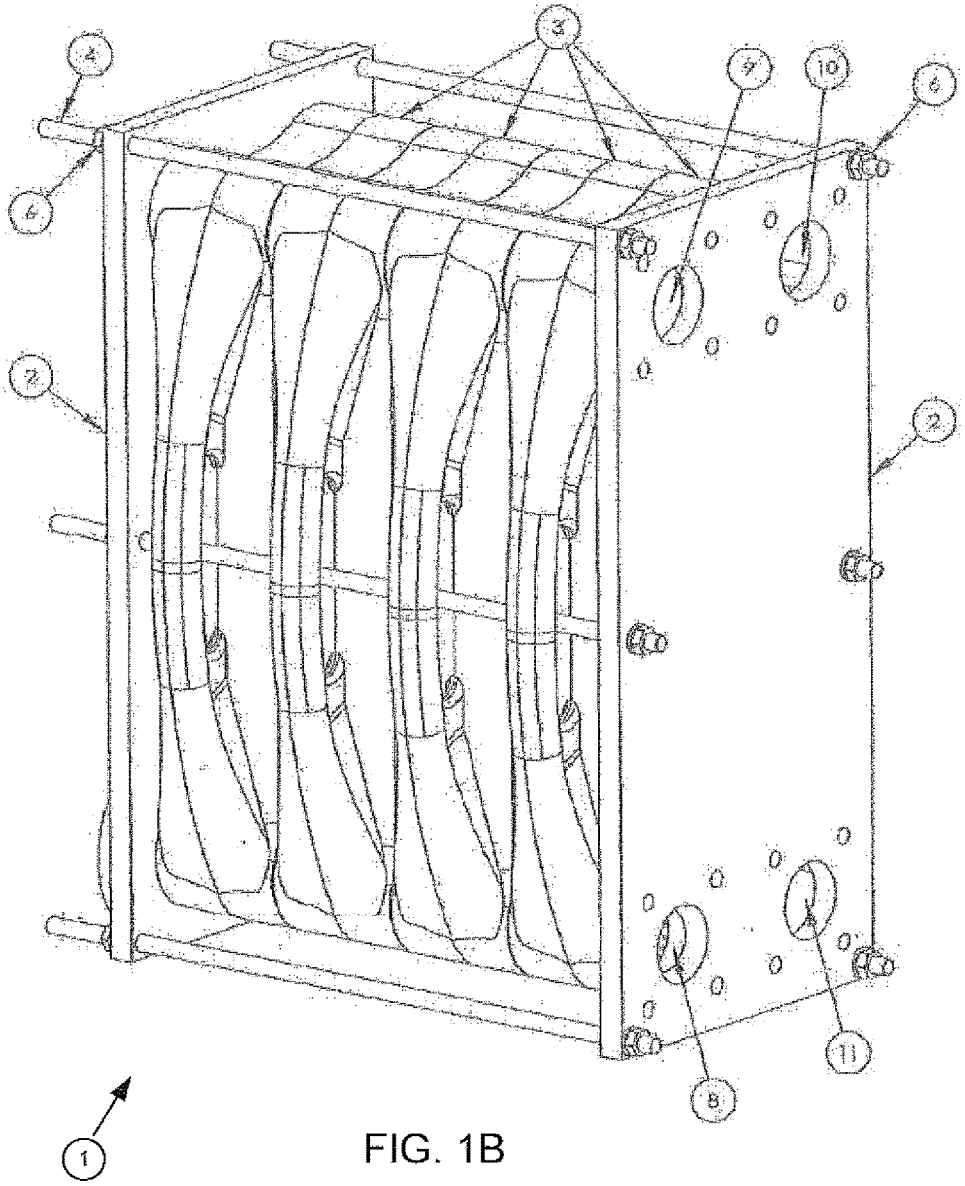

FIG. 1 shows a system 1 for heat exchange between fluids according to the present disclosure, where the system 1 is in the process of being assembled (or taken apart) in FIG. 1A and where the system 1 is shown fully assembled in FIG. 1B.

The system 1 for heat exchange between fluids according to the present disclosure is constituted of two end plates 2, between which end plates 2 are arranged four open elements 3 for heat exchange between fluids according to the illustrated embodiment. It should however be understood that a greater or smaller number of open elements 3 can be arranged between the end plates 2, this number depending on the space available, desired capacity, back-up capacity and development potential. At least two elongate elements 4 are suitably 6 connected to one of the end plates 2, where at least one of the elongate elements 4 is connected in an area close to each of the end plate's 2 edges. The other end plate 2 is configured with at least one through hole, slot, cut-out 5 or the like in an area close to each of the end plate's edges 2, such that the at least one through hole, slot, cut-out 5 or the like in each edge of the one end plate 2 is used for passage of at least one of the elongate elements 4 in the other end plate 2, so as to assemble and connect the two end plates 2. The elongate element 4 will then be configured with a threaded portion (not shown) over a part of its length. The two end plates 2 will then be connected in that the at least one elongate element 4 in each of the edges of the one end plate 2 is passed through the at least one through hole, slot, cut-out 5 in the other end plate 2. A nut 6 will then be screwed onto each of the elongate elements 4, so as to assemble the end plates 2 and the open elements 3 arranged between the end plates 2.

An inlet filter 7 is in a suitable way, for example, with the aid of bolts or the like, connected to one of the end plates 2, which inlet filter 7 will reduce the danger of physical blockages in the system 1 for heat exchange between fluids, as a result of contaminants in one or both of the fluids to be heat exchanged.

One of the end plates 2 is further configured with an inlet and outlet 8, 9; 10, 11 for each of the fluids to be heat exchanged, where the inlet and outlet 8, 9 for a first fluid and the inlet and outlet 10, 11 for a second fluid are arranged on opposite edges of the end plate 2.

The inlet 8 for the first fluid will then be arranged diagonally opposite to the inlet 10 for the second fluid, and similarly the outlet 9 for the first fluid will be arranged diagonally opposite the outlet 11 for the second fluid. Thus, the fluids that are to be heat exchanged will flow in the opposite direction to each other when the system 1 for heat exchange between fluids is used, so as to achieve optimal heat transfer between the fluids.

How the pipes (not shown) for supply of the fluids to be heat exchanged are to be connected to the modular system 1 for heat exchange between fluids is not described in any detail here, as a person of skill in the art will know how this is to be done.

As disclosed above, the modular system 1 for heat exchange between fluids comprises a plurality of open elements 3, which open elements 3 will be described in more detail with reference to FIGS. 2 and 3. The open elements 3 are so arranged between the end plates 2 that two sides facing each other in two adjacent open elements 3 will carry the same fluid, which will mean, with reference to FIG. 1, that a first and a second open element 3 in the sides facing each other will carry the first fluid, whilst sides in the second and a third open element 3 will then carry the second fluid.

Figure 2A:
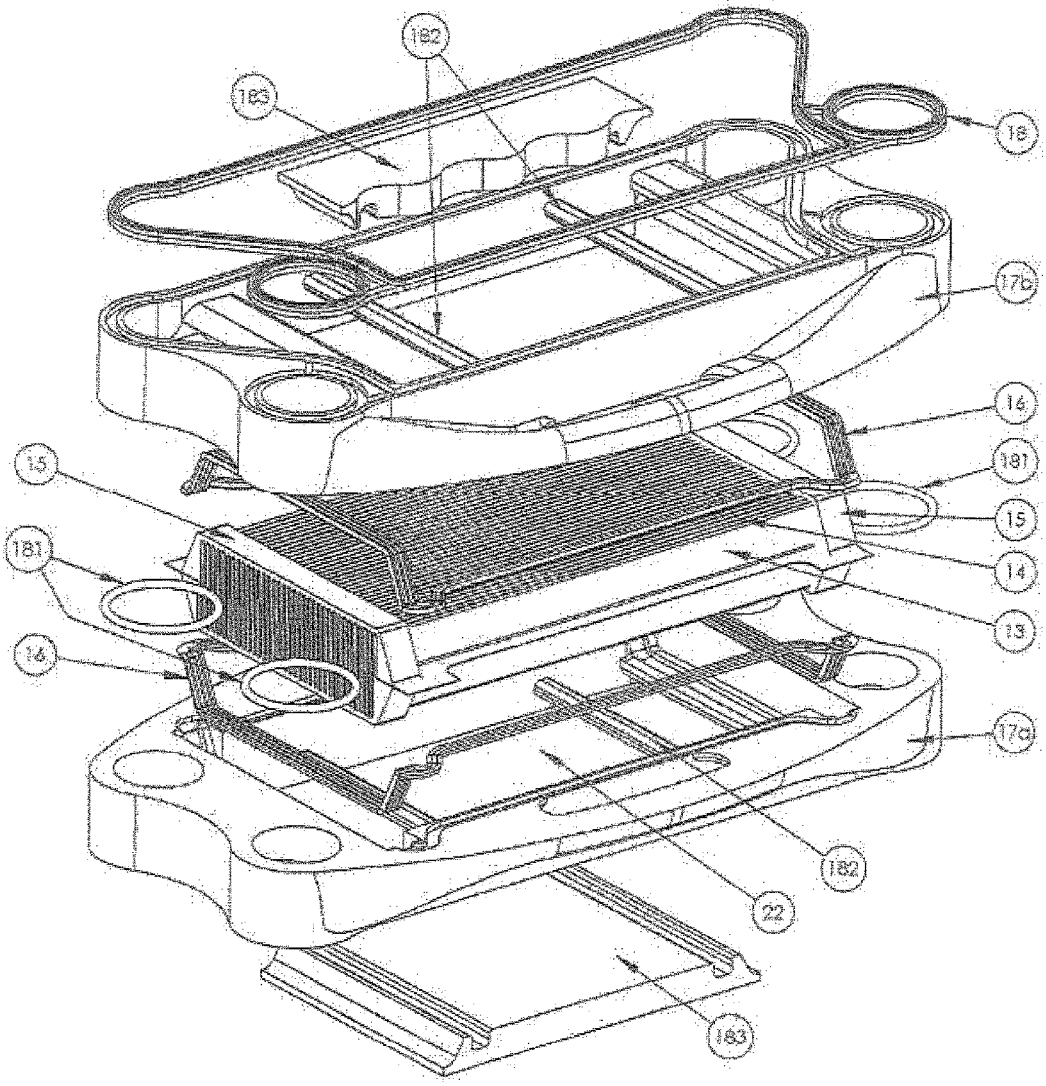
FIGS. 2A-B show an open element for heat exchange between fluids in the modular system shown in FIG. 1.
Figure 2B:
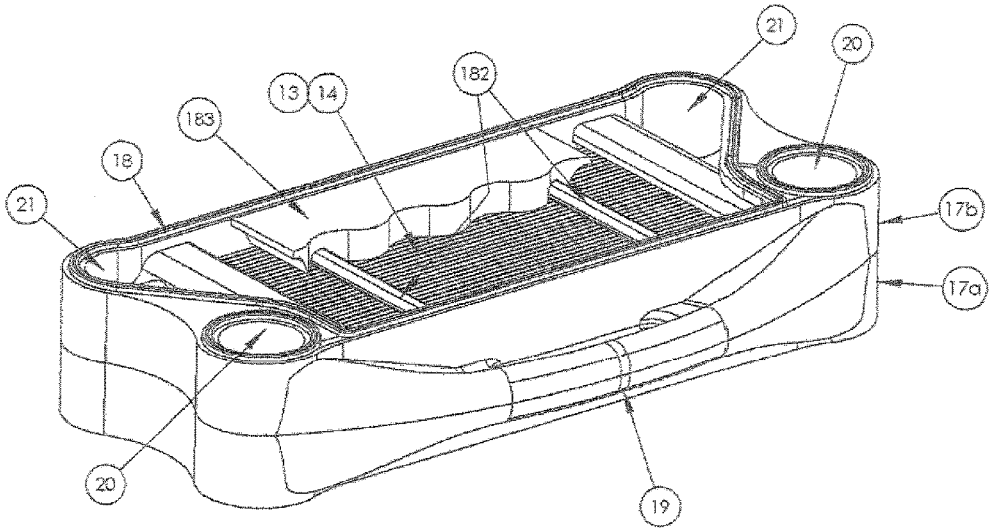

FIGS. 2A-B show an open element 3 according to the present disclosure, where FIG. 2A shows the different components of the open element 3, whilst FIG. 2B shows the fully assembled open element 3. The main component of the open element 3 is constituted of a sheet material 13 which is folded to form a plurality of slits 14 (see also FIGS. 3 and 4). The sheet material 13, at each of its short ends, across the whole length of the short end, is sealed by means of an end seal 15. In addition, two permanent gaskets 16 are provided around the folded sheet material 13, each of the permanent gaskets 16 being configured so as to cover half of the end edges of the folded sheet material 13. When the folded sheet material 13 with the end seal 15 and the two permanent gaskets 16 are arranged in a frame 17, which is constituted of a bottom frame 17*a* and a top frame 17*b*, a tight connection will be formed between the edges of the folded sheet material 13 and the frame 17. However, as an extra safety measure, the frame 17 will be configured with a plurality of through holes (not shown) which extend into the outer side of the permanent gaskets and end seal 15, such that if the end seal 15 or the permanent gaskets 16 for some reason begin to leak, the though holes (not shown) in the frame 17 will act as outlets for one or both fluids that are passed through the open element 3. This means that any leakage from the open element 3 will not result in a mixing of the fluids that are to be heat exchanged.

The frame 17 will further comprise one or more service gaskets 18, these being arranged in the outer sides of the top and bottom frames 17*a*, 17*b*. In this way, when a plurality of open elements 3 are arranged in the system 1 for heat exchange between fluids, a sealed connection will be formed between the open elements 3.

The frame 17 will also comprise a carrying handle 19, such that the open element 3 can easily be handled during the assembly or dismantling of the system 1 for heat exchange between fluids.

In the frame 17, out towards each of the two ends of the frame 17, through holes 20, 21 are formed, where the through holes 20 constitute inlets for each of the fluids, whilst the through holes 21 constitute the outlets for each fluid. Each end of the frame 17 will thus be configured with one inlet and one outlet. The inlet and outlet for one of the fluids will then be on one side of the open element 3, whilst the inlet and outlet for the other fluid will be arranged on the opposite side of the open element 3. The first fluid will then be passed into the open element 3 on one side, flow through the slits 14 in the folded sheet material 13 and then be passed out of the open element 3 on the same side. The other fluid will be passed into the open element 3 on an opposite side and end to the first fluid, flow over the folded sheet material 13 on the opposite side of the folded sheet material 13 and opposite the first fluid, whereafter the second fluid is passed out of the open element 3 at an opposite end to the inlet thereof. This arrangement will give optimum heat exchange between the two fluids.

In addition, one or more gaskets 181 will be arranged between the through holes 20, 21 when the frame 17 has been assembled.

The top and bottom frame 17*a*, 17*b* are configured with an open portion 22, such that when the folded sheet material 13 is arranged in the frame 17, most of the surface of the folded sheet material 13 will be exposed to a fluid that is to flow through the open element 3. Through this arrangement, where the frame 17 will only cover the edges of the folded sheet material 13 and the height of the sheet material 13, a large area of the folded sheet material 13 will be capable of being used efficiently for heat transfer between fluids.

In FIG. 2B two transverse elements 182 are connected to the bottom frame 17*b*, which transverse elements 182 will extend over the whole width of the bottom frame 17*b*. These transverse elements 182 will stiffen the folded sheet material 13.

To obtain a proper flow of the fluid across the open element 3, a plate 183 may be arranged adjacent to the transverse elements 182. Such a plate 183 may then be arranged on one or both sides of the open element 3, see also FIG. 2A. The plate 183 will then "force" the fluid to flow through the slits in the open element 3.

An open element 3 is thus provided where the effective heat transfer area exceeds the external area of the open element. Furthermore, an open element 3 will be provided where the slits 14 in the folded sheet material 13 are visible and accessible for cleaning, for example, by high pressure washing.

Figure 3A:
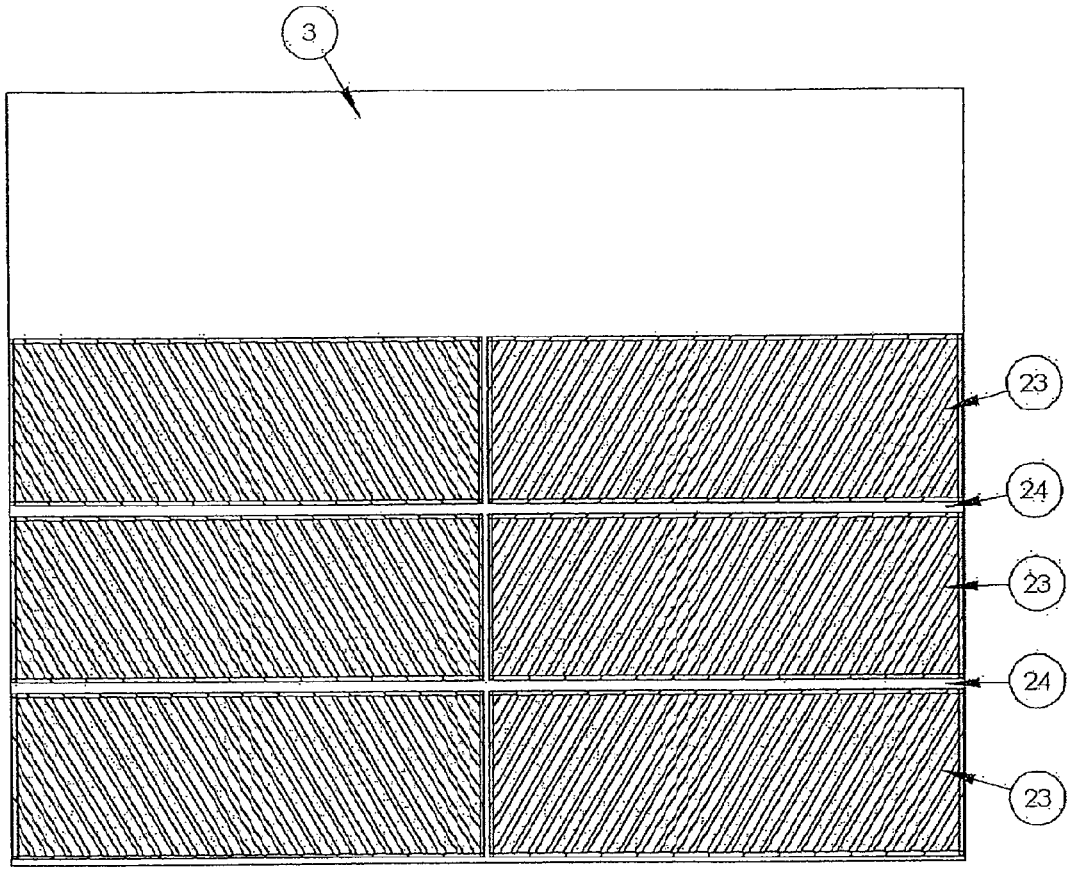
FIGS. 3A-B show a sheet material in the open element for heat exchange between fluids, where the sheet material is shown prior to the folding and as fully folded.
Figure 3B:
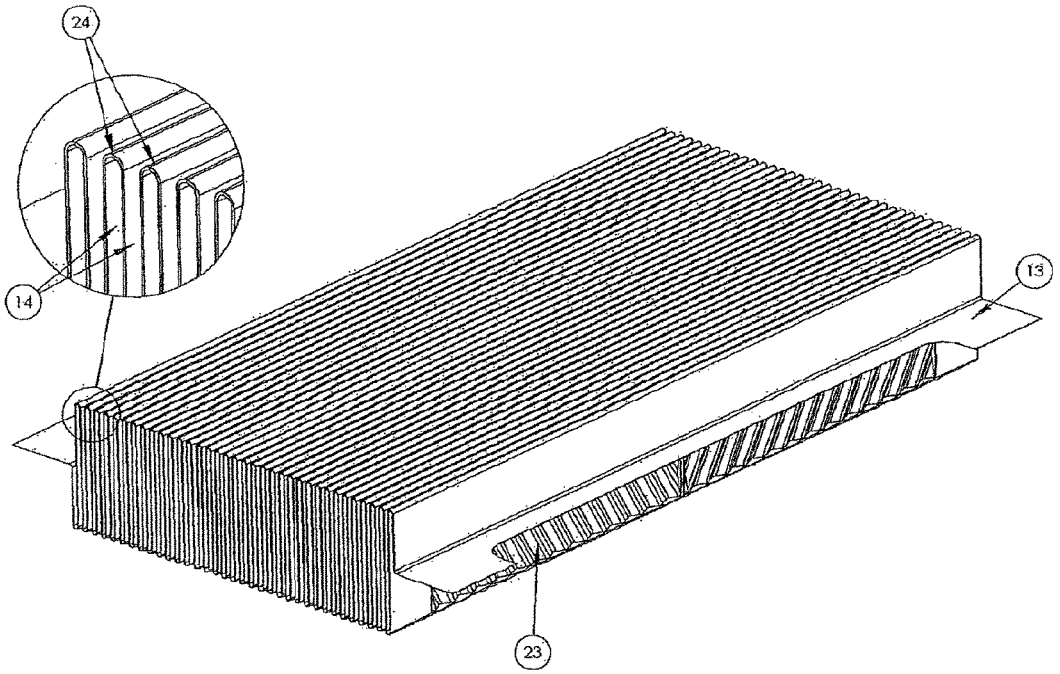

FIGS. 3A-B show the sheet material 13 that is used in the open element 3, and it is seen that the sheet material 13 is configured with a plurality of stamped portions 23 and non-stamped portions 24 arranged between them. The stamped portions 23 will, when the sheet material 13 is folded, constitute slits 14 in the open element 3, through which slits 14 a fluid is to flow. The non-stamped portions 24 will then form the "folding points" for the sheet material 13. See also FIG. 4, where a fully folded sheet material 13 is shown. The stamping of the stamped portions 23 will provide necessary strength in the open element 3 to prevent the open element 3 from collapsing if the differential pressure across the open element 3 becomes too great, and will provide a turbulent flow in the fluids that are run through the open element 3.

The stamping here is shown as a "V-shape", but a person of skill in the art will understand that the stamping may also have other "patterns".

The stamping may, for example, be done in a press (not shown) or the like, where the sheet material 13 is fed through the press, a portion 23 is stamped, the press is lifted and a new length of the sheet material 13 is advanced in the press, whereafter the press stamps a new portion 23. This process is repeated until the desired number of stamped portions 23 has been obtained.

Figure 4:
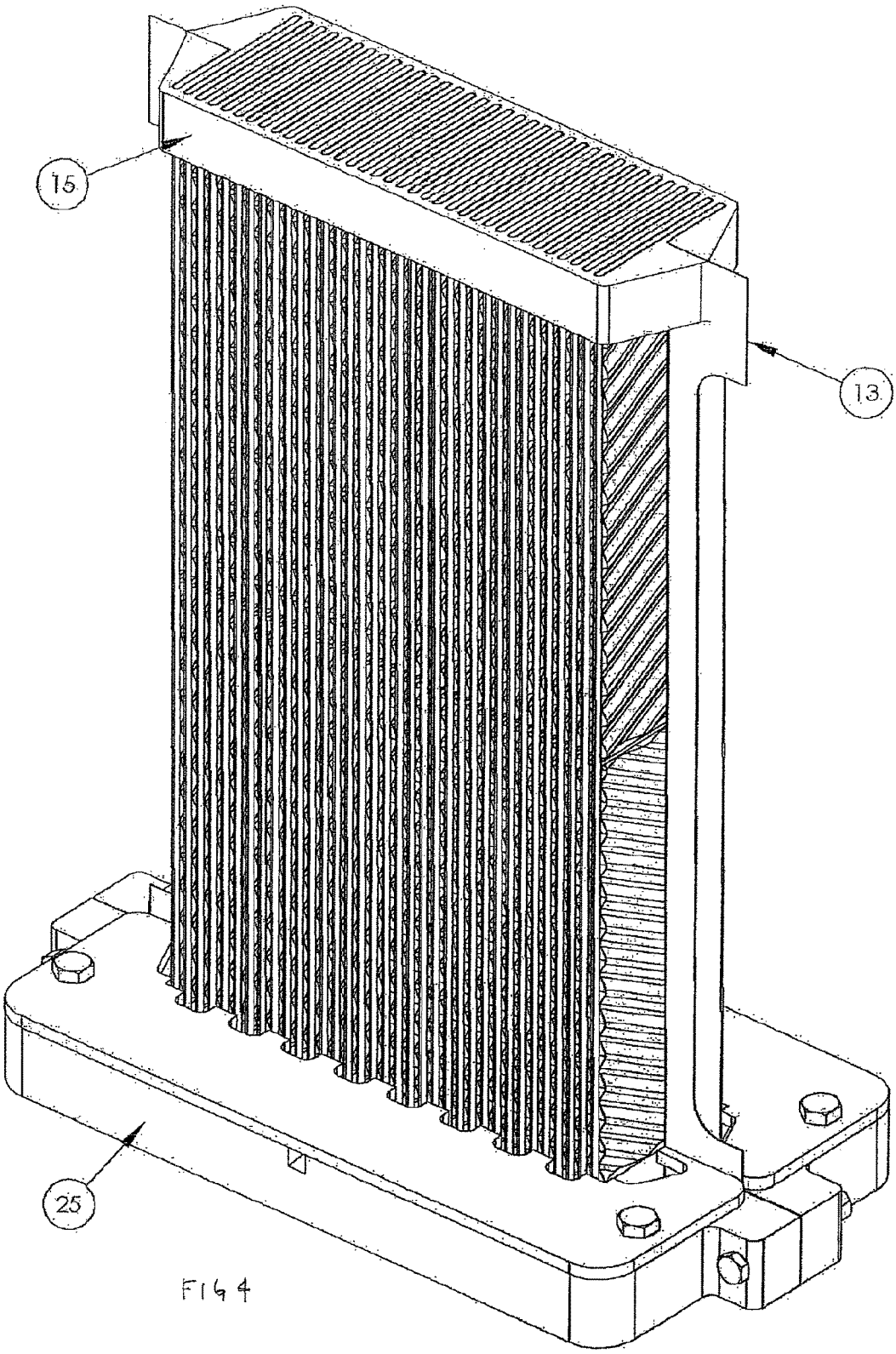
FIG. 4 shows the fully folded sheet material with sealed end faces.

The sheet material 13 will then through a "folding process" be folded about the stamped portions 24, such that the sheet material 13 will have a form as shown in FIG. 4. This will provide a folded sheet material 13, where two stamped portions 23 will form a slit 14 in the open element 3, where the first fluid that flows through a slit 14 on one side of the folded sheet material 13 will be "surrounded" by two slits 14 on the other side of the folded sheet material 13, through which two slits 14 the second fluid flows.

Although the slits 14 in FIGS. 3A-B and 4 are shown as planar faces, it should be understood that they may be configured as part circles, arcs or the like.

The first and the last portion of the sheet material 13 will be configured with an extra "folding point", where the fold is made in half the width of this portion. The fold is made so that a part of this first and last portion will be arranged perpendicular to the subsequent stamped portion 23; see also FIG. 4. This folded portion, i.e., the portion that projects perpendicularly out from the folded sheet material 13, will then constitute attachment points for the end seals 15 of the folded sheet material 13 and be a contact face for the permanent gaskets 16.

When the sheet material 13 is folded as shown in FIG. 3B, the folded sheet material 13 will be arranged in a mould 25 and a mass that is to constitute the end seal 15 of the folded sheet material 13 is then added to the mould 25. This is shown in FIG. 4, where it can be seen that one end of the folded sheet material 13 already has an end seal 15 applied thereto, whilst the other end of the folded sheet material 13 has been put into the mould 25 for sealing of the end.

When the other end of the folded sheet material 13 also has an end seal 15 applied thereto and this has hardened, the folded sheet material 13, with end seals 15, will be equipped with the permanent gaskets 16, whereafter these are arranged in the bottom frame 17*b*. The top frame 17*a* will subsequently be arranged over the bottom frame 17*b*, containing the folded sheet material 13 and the permanent gaskets 16, whereafter the top and bottom frames 17*a*, 17*b* are by means of suitable devices (not shown), for example, screws, bolts or the like, connected to each other so as to form an open element 3.

A plurality of open elements 3 will then be placed between end plates 2, whereafter the end plates 2 are by means of the elongate elements 4 and nuts 6 connected so as to form a system 1 for heat exchange between fluids.

The present disclosure has now been explained with reference to a non-limiting exemplary embodiment. A person of skill in the art will understand however that a number of variations and modifications can be made to the system for heat exchange between fluids and the open element as described within the scope of the present disclosure, as defined in the appended claims.

The invention claimed is:

1. An open element for heat exchange between fluids, comprising:

a sheet material folded to form a plurality of slits, which constitute the fluids' flow paths, wherein the sheet material over at least a part of its width and length is by means of stiffening devices stiffened, wherein the ends of the folded sheet material are sealed by means of an end seal, wherein the open element further comprises an open frame, the folded sheet material being arranged in the open frame, wherein the open frame is constituted of a top frame and a bottom frame, each of which includes two through holes at each end forming an inlet and an outlet for each of the fluids' flow paths, and each of which includes a centrally open portion, between the inlets and the outlets, wherein the open frame thereby covering all edges of the folded sheet material, permanent gaskets further being arranged in each of the top and bottom frames, each of the permanent gaskets being configured to cover half of the end edges of the folded sheet material.

2. The element according to claim 1, wherein the sheet material is made of titanium.

3. The element according to claim 1, wherein the element further comprises at least one service gasket.

4. The element according to claim 1, wherein the slit width to slit depth ratio is less than 0.15.

5. The element according to claim 1, wherein walls of the slits are configured as planar faces, semi-circles, or arcs.

6. The element according to claim 1, wherein the top and bottom frames are connected to each other by fastening devices.

7. The element according to claim 6, wherein the frame in at least one side is configured with at least one through hole, extending into at least one of the permanent gaskets.

8. A modular system for heat exchange between fluids, comprising:

two end plates, wherein at least one end plate is configured with inlets and outlets for fluids, wherein the modular system comprises a plurality of open elements according to claim 1, which open elements are so arranged that two adjacent open elements on sides facing each other carry the same fluid.

9. The modular system according to claim 8, wherein at least one elongate element is arranged in an area out towards the edge of each of the ends of one of the end plates, and where the other end plate is configured with at least one through hole in an area out towards the edge of each of the ends of the end plate, so as to be able to assemble the end plates.

10. The modular system according to claim 8, wherein the modular system comprises at least one filter.

* * * * *